US011247318B2

(12) United States Patent
Lin

(10) Patent No.: US 11,247,318 B2
(45) Date of Patent: Feb. 15, 2022

(54) TORQUE WRENCH

(71) Applicant: TORQUE-TECH PRECISION CO., LTD., Taichung (TW)

(72) Inventor: Tien-Lung Lin, Taichung (TW)

(73) Assignee: TORQUE-TECH PRECISION CO., LTD., Taichung (TW)

( * ) Notice: Subject to any disclaimer, the term of this patent is extended or adjusted under 35 U.S.C. 154(b) by 181 days.

(21) Appl. No.: 16/741,351

(22) Filed: Jan. 13, 2020

(65) Prior Publication Data

US 2021/0138618 A1 May 13, 2021

(30) Foreign Application Priority Data

Nov. 8, 2019 (TW) ..... 108140666

(51) Int. Cl.
*B25B 23/142* (2006.01)
*B25B 23/14* (2006.01)

(52) U.S. Cl.
CPC ..... *B25B 23/1427* (2013.01); *B25B 23/141* (2013.01)

(58) Field of Classification Search
USPC ..... 81/447, 467, 475, 478, 480, 481, 482
See application file for complete search history.

(56) References Cited

U.S. PATENT DOCUMENTS

2014/0352503 A1* 12/2014 Hsieh ..... B25B 23/1427 81/478
2015/0343621 A1* 12/2015 Hsieh ..... B25B 23/1427 81/467
2016/0243686 A1* 8/2016 Hsieh ..... B25B 13/462
2017/0209993 A1* 7/2017 Owen ..... B25B 23/1427
2019/0160635 A1* 5/2019 Hsieh ..... B25B 13/462

* cited by examiner

*Primary Examiner* — Joseph J Hail
*Assistant Examiner* — Dana Lee Poon
(74) *Attorney, Agent, or Firm* — Sinorica, LLC

(57) ABSTRACT

A torque wrench includes a tubular body. One end of the tubular body is connected to a driving head, and the other end has a grip. The tubular body includes a retaining unit, an elastic unit, a push rod, and an adjusting unit therein. One side of the retaining unit comprises a blind hole corresponding to the push rod for accommodation of an extension portion, and the other side is formed with a through hole for insertion of a thin rod portion, furthermore, the through hole has a diameter less than that of the blind hole, the retaining unit enables to bear the elastic unit. The retaining unit can be fixed at an end opening of the tubular body by a welding means or integrally formed with the tubular body, so as to achieve the effects of facilitating production assembly and reducing production cost.

9 Claims, 9 Drawing Sheets

TORQUE WRENCH

FIELD OF THE INVENTION

The present invention relates to a torque wrench.

BACKGROUND OF THE INVENTION

Referring to FIG. 1, a conventional torque wrench mainly includes a tubular body 1. One end of the tubular body 1 is connected to a driving head 3 through a release mechanism 2. The other end of the tubular body 1 is provided with a grip 4. A retaining block 5 and a compression spring 6 are disposed in the tubular body 1. One end of the push rod 7 is connected to the driving head 3. The other end of the push rod 7 passes through the retaining block 5 and the compression spring 6, and is threadedly connected to an adjusting member 8 for adjusting the elastic force of the compression spring 6.

However, the retaining block 5 of the above-mentioned conventional torque wrench is disposed in the middle section of the tubular body 1. A large-diameter section of the push rod 7 is approximately equal to the inner diameter of the tubular body 1. In assembly, after installing the push rod 7 from the left side of the tubular body 1 into the tubular body 1 by the assembler, the retaining block 5 is subject to the large-diameter section of the push rod 7 and can only be placed into the tubular body 1 from the right side of the tubular body 1. In this way, because the stroke from the right side of the tubular body 1 to the predetermined position for disposing the retaining block 5 is extremely long and there is no positioning mechanism in the tubular body 1, it is difficult for the assembler to insert the retaining block 5 into the predetermined position.

Referring to FIG. 2, the retaining block 5 of the conventional torque wrench is fixed by a plurality of pins 9 that are inserted in the tubular body 1. The pin holes 1A of the tubular body 1 need to be aligned with the pin holes 5A of the retaining block 5 so that the pins 9 are able to be inserted into the retaining block 5 via the tubular body 1. Therefore, in assembly, the assembler spends a lot of time adjusting the position for the pins 9 to be inserted into the pin holes 1A, 5A.

Accordingly, the inventor of the present invention has devoted himself based on his many years of practical experiences to solve these problems.

SUMMARY OF THE INVENTION

The primary object of the present invention is to provide a torque wrench. The torque wrench includes a retaining unit located at an end opening of a tubular body. The retaining unit can be fixed in the tubular body by a welding means or integrally formed with the tubular body, so as to achieve the effects of facilitating production assembly and reducing production cost.

In order to achieve the above object, the present invention provides a torque wrench. The torque wrench comprises a tubular body. The tubular body has two ends defined as a first end portion and a second end portion. The first end portion is connected to a driving head through a release mechanism. The second end portion is provided with a grip. A retaining unit is fixed in the tubular body. The retaining unit is fixedly connected to an end opening of the first end portion. The retaining unit has a first side adjacent to and facing the driving head and a second side adjacent to and facing the elastic unit. The first side is recessed with a blind hole. The second side is formed with a through hole communicating with the blind hole. The through hole has a diameter less than that of the blind hole. The second side has a cross-sectional area greater than that of the first side. An elastic unit is received in the tubular body. The elastic unit is inserted into the tubular body from the second end portion. One end of the elastic unit is abutted against the retaining unit. A push rod is insertedly disposed in the tubular body. The push rod has a connecting portion connected to the driving head. The connecting portion is provided with an extension portion extending toward the blind hole. The extension portion has a diameter equivalent to the diameter of the blind hole so that the extension portion can stably slide along an axial direction of the blind hole. The extension portion is provided with a thin rod portion extending toward the through hole. The thin rod portion passes through the through hole and the elastic unit and is formed with a threaded portion. An adjusting unit is threadedly connected to the threaded portion and abuts against another end of the elastic unit.

In the torque wrench provided by the present invention, the outer diameter of the retaining unit is not greater than the inner diameter of the tubular body, and the diameter of the extension portion is not greater than the diameter of the blind hole of the retaining unit. Therefore, when the retaining unit is fixed at the end opening of the first end portion of the tubular body, the extension portion can still be slidably disposed in the blind hole of the retaining unit. Besides, the second side is provided with the through hole, and the diameter of the through hole is less than the diameter of the blind hole, so the cross-sectional area of the second side is greater than the cross-sectional area of the first side, so as to carry the elastic unit effectively.

Thereby, the retaining unit can be disposed at the end opening of the tubular body and fixed by a welding means or integrally formed with the tubular body, so that the invention has the advantages of easy production and assembly compared with the design of the prior art.

DETAILED DESCRIPTION OF THE PREFERRED EMBODIMENTS

Embodiments of the present invention will now be described, by way of example only, with reference to the accompanying drawings.

Figure 1:
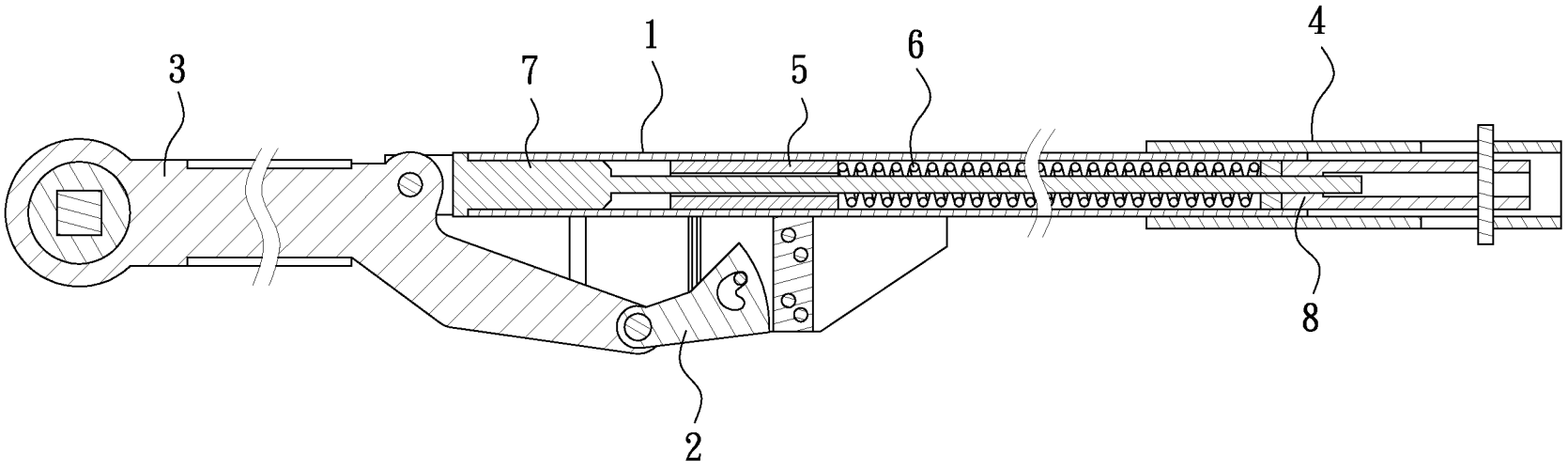
FIG. 1 PRIOR ART
FIG. 1 is a cross-sectional view of a conventional torque wrench.
Figure 2:
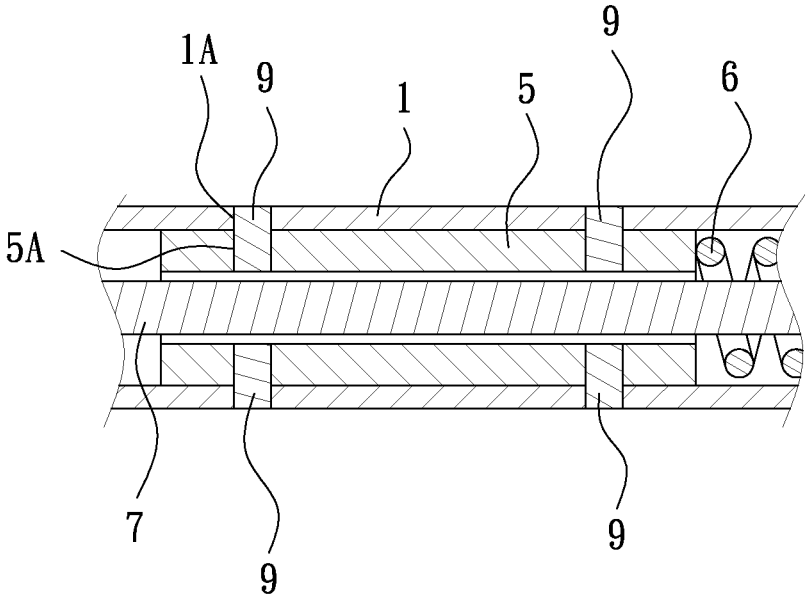
FIG. 2 PRIOR ART
FIG. 2 is a partially enlarged view of the conventional torque wrench.
Figure 3:
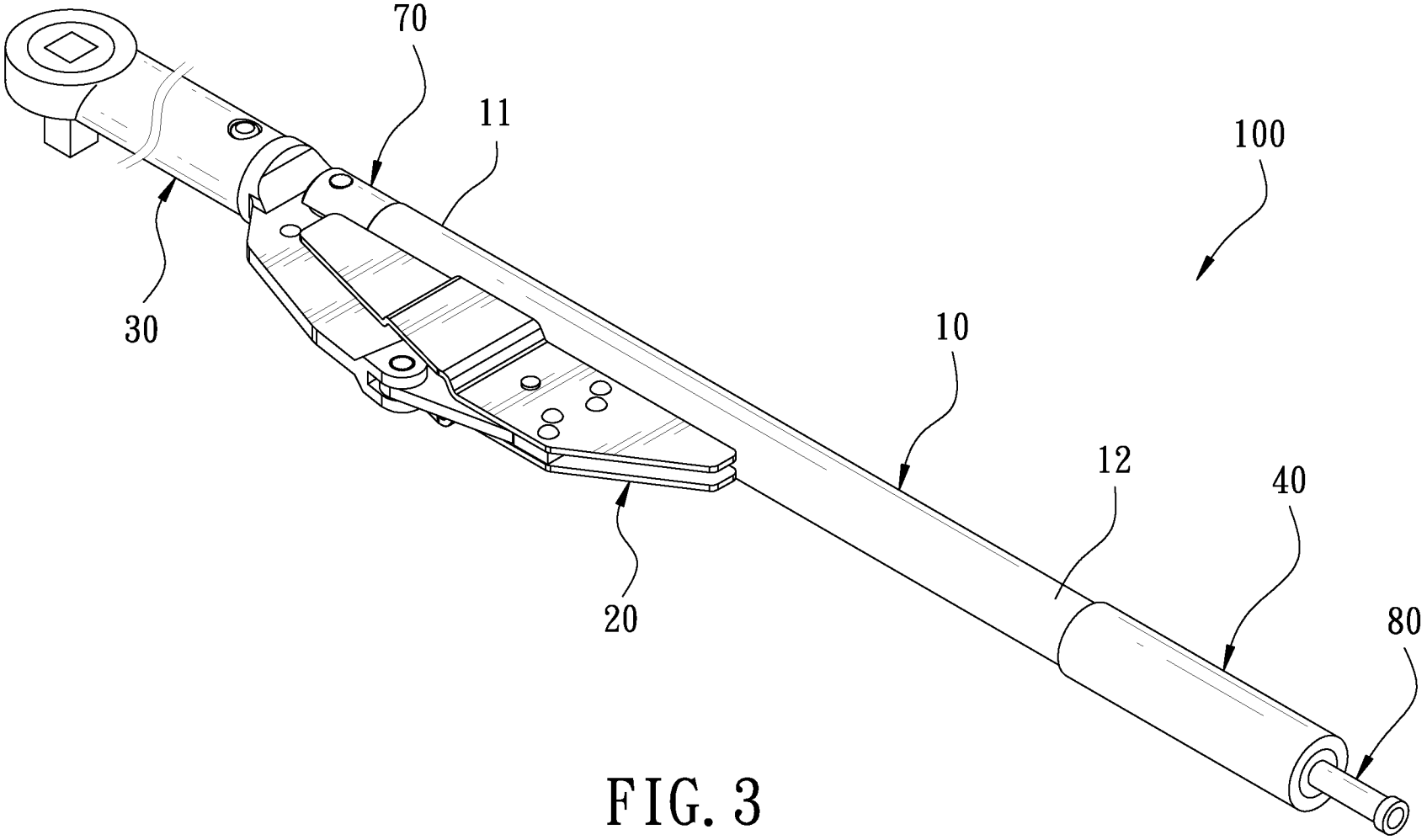
FIG. 3 is a perspective view in accordance with a first embodiment of the present invention.

FIG. 3 is a perspective view in accordance with a first embodiment of the present invention. The present invention discloses a torque wrench 100. The torque wrench 100 mainly includes a tubular body 10. The tubular body 10 has two ends defined as a first end portion 11 and a second end portion 12. The first end portion 11 is connected to a driving head 30 through a release mechanism 20. The second end portion 12 is provided with a grip 40.

Figure 4:
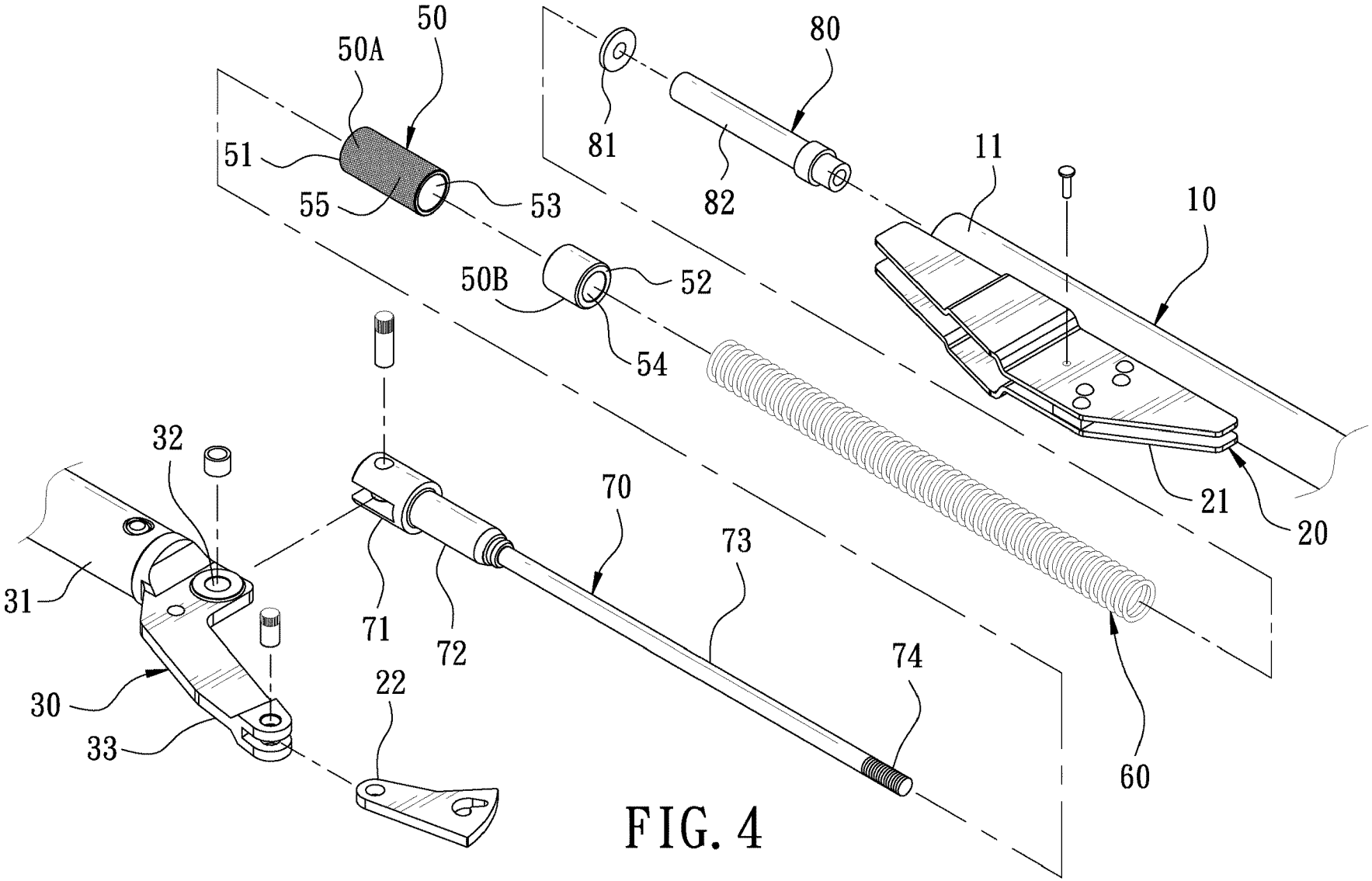
FIG. 4 is an exploded view in accordance with the first embodiment of the present invention.

FIG. 4 is an exploded view in accordance with the first embodiment of the present invention. The release mechanism 20 is disposed on an outer wall of the tubular body 10 adjacent to the first end portion 11, and has a casing 21. The casing 21 is provided with a detent member 22. The driving head 30 has a driving portion 31 for driving a workpiece. The driving portion 31 is provided with a coupling portion 32. The coupling portion 32 has a forked post 33 extending from a circumferential side of the coupling portion 32. The forked post 33 is connected to the detent member 22. A retaining unit 50 is fixed in the tubular body 10. The retaining unit 50 has a first side 51 adjacent to and facing the driving head 30 and a second side 52 adjacent to and facing an elastic unit 60. The first side 51 is recessed with a blind hole 53, and the second side 52 is formed with a through hole 54 communicating with the blind hole 53. The elastic unit 60 is received in the tubular body 10. The elastic unit 60 is inserted into the tubular body 10 from the second end portion 12. One end of the elastic unit 60 is abutted against the retaining unit 50. A push rod 70 is insertedly disposed into the tubular body 10. The push rod 70 has a connecting portion 71. One side of the connecting portion 71 is connected to the coupling portion 32 of the driving head 30. Another side of the connecting portion 71 is provided with an extension portion 72 extending toward the blind hole 53. The extension portion 72 is provided with a thin rod portion 73 extending toward the through hole 54. The extension portion 72 and the thin rod portion 73 of the push rod 70 are inserted into the tubular body 10 from the first end portion 11. The thin rod portion 73 passes through the through hole 54 and the elastic unit 60, and is formed with a threaded portion 74. The threaded portion 74 is provided with an adjusting unit 80. The adjusting unit 80 has a pressing member 81 pressed against another end of the elastic unit 60 and an adjusting member 82 screwed on the threaded portion 74 for adjusting the elastic force of the elastic unit 60.

Figure 5:
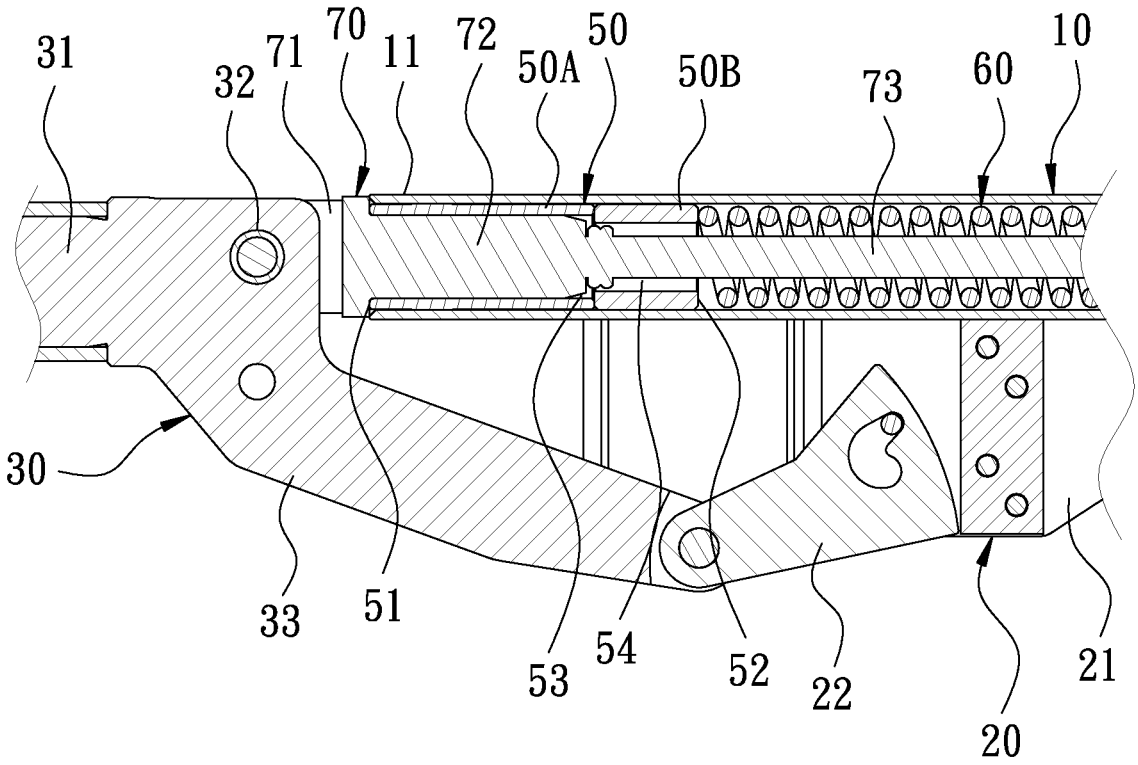
FIG. 5 is a cross-sectional view in accordance with the first embodiment of the present invention.

FIG. 5 is a cross-sectional view in accordance with the first embodiment of the present invention. In this embodiment, an outer diameter of the retaining unit 50 is not greater than an inner diameter of the tubular body 10, so the retaining unit 50 can be placed in the tubular body 10 and located at the end opening of the first end portion 11. In addition, since the first side 51 of the retaining unit 50 is provided with the blind hole 53 and a diameter of the extension portion 72 of the push rod 70 is not greater than a diameter of the blind hole 53 of the retaining unit 50, the extension portion 72 of the push rod 70 is slidably disposed in the retaining unit 50. In this embodiment, the diameter of the extension portion 72 is equivalent to the diameter of the blind hole 53, so that the extension portion 72 enables to stably slide along the axial direction of the blind hole 53. The second side 52 of the retaining unit 50 is provided with the through hole 54. Since a diameter of the through hole 54 is less than that of the blind hole 53, the second side 52 has a cross-sectional area greater than that of the first side 51. The sufficient bearing area enables to hold the elastic unit 60 effectively. Thereby, the predetermined position of the retaining unit 50 is located at the end opening of the first end portion 11, which facilitates the assembler to assemble and position the retaining unit 50. Further, an outer wall of the retaining unit 50 can be firmly fixed by a welding means, such as thermal welding process, so that the retaining unit 50 possesses sufficient bearing capacity to bear the elastic force from the elastic unit 60. Compared with the prior art, drilling holes in the tubular body 10 and the retaining unit 50 is not required, and there is no need to adjust the exact position of the retaining unit 50 in a time-consuming manner. The invention has the advantages of easy production and assembly.

It should be noted that, in this embodiment, the retaining unit 50 is composed of a first cylinder 50A fixed at the end opening of the first end portion 11 and a second cylinder 50B located between the first cylinder 50A and the elastic unit 60. The first side 51 is located on one side of the first cylinder 50A facing the driving head 30. The second side 52 is located on one side of the second cylinder 50B facing the elastic unit 60. The second side 52 is a bearing surface for bearing the elastic unit 60. The first cylinder 50A is provided with the blind hole 53. The second cylinder 50B is provided with the through hole 54. Thereby, since the outer diameter of the first cylinder 50A is not greater than the inner diameter of the tubular body 10, the assembler can easily place the first cylinder 50A at the end opening of the first end portion 11. At this time, the outer wall of the first cylinder 50A can be attached to an inner wall of the tubular body 10 by a welding means for bearing the second cylinder 50B and the elastic unit 60. In addition, since the outer diameter of the second cylinder 50B is approximately equal to the outer diameter of the first cylinder 50A and the diameter of the blind hole 53 of the first cylinder 50A is greater than the diameter of the through hole 54 of the second cylinder 50B, the second side 52 of the second cylinder 50B possesses the bearing surface greater than that of the first side 51 to bear the elastic unit 60. Through the two-piece design, the retaining unit 50 can be assembled and positioned with ease, and enables to bear a large torsion spring. The manufacturing difficulty and cost of the retaining unit 50 can be reduced greatly.

It is worth mentioning that the outer wall of the first cylinder 50A of the retaining unit 50 is formed with a rough surface 55 by knurling or the like, as shown in FIG. 4. When the assembler attempts to position the first cylinder 50A to the end opening of the first end portion 11 of the tubular body 10, the identifiability of the rough surface 55 enables the assembler to define a predetermined position for assembly. In this invention, the knurling may be processed on part or full of the outer wall of the first cylinder 50A.

Figure 6:
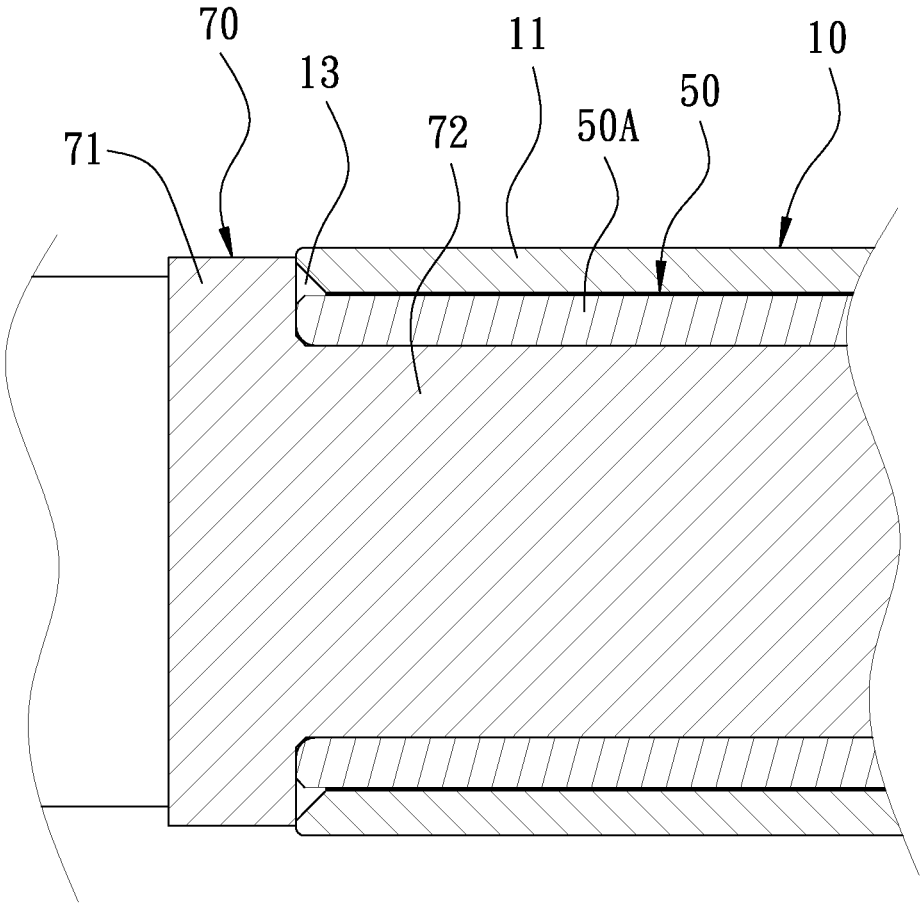
FIG. 6 is a partially enlarged view in accordance with the first embodiment of the present invention.

FIG. 6 is a partially enlarged view in accordance with the first embodiment of the present invention. The tubular body 10 has a flared opening 13 at the junction of the inner wall of the tubular body 10 and the end opening of the first end portion 11. Thereby, it is convenient for the retaining unit 50 to be placed into the tubular body 10 and for some welding material to be injected between the first cylinder 50A of the retaining unit 50 and the inner wall of the tubular body 10.

Figure 7:
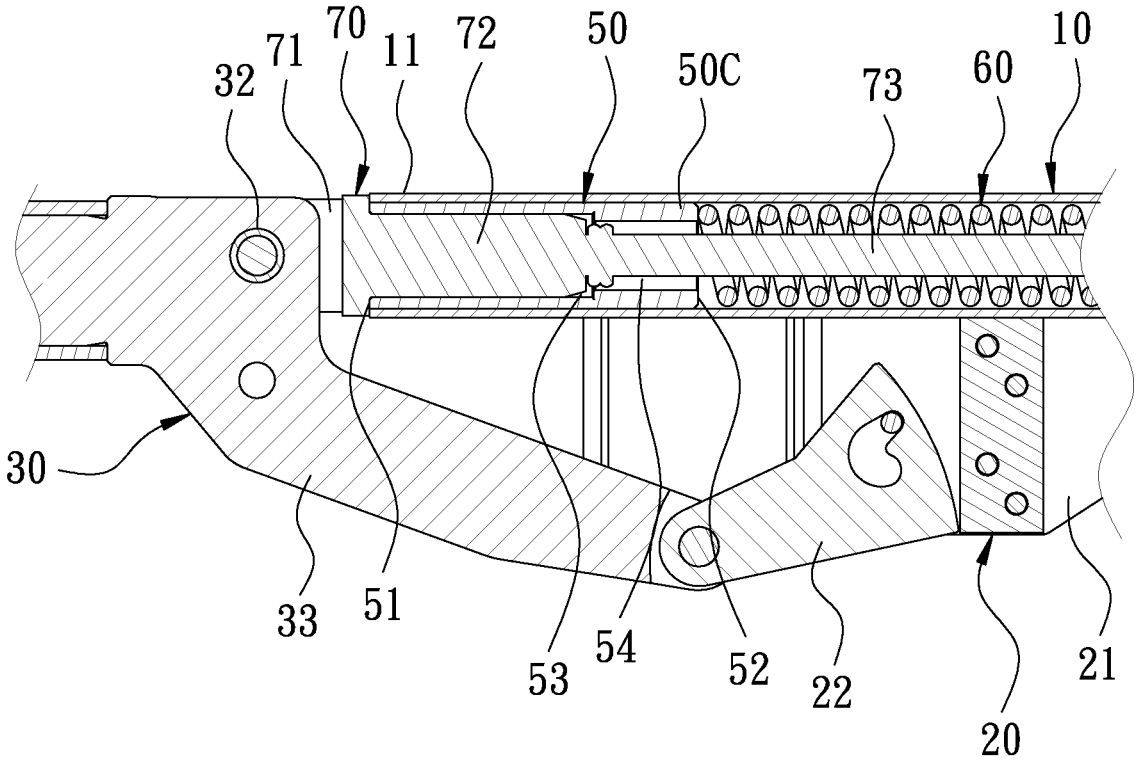
FIG. 7 is a partially enlarged view in accordance with a second embodiment of the present invention.

FIG. 7 is a partially enlarged view in accordance with a second embodiment of the present invention. The torque wrench 100 of the second embodiment is substantially similar to the first embodiment with the exceptions described hereinafter. The retaining unit 50 is a hollow sleeve 50C. The blind hole 53 is disposed on one side of the hollow sleeve 50C, and the through hole 54 is disposed on another side of the hollow sleeve 50C. The first side 51 is located on the side of the hollow sleeve 50C facing the driving head 30, and the second side 52 is located on the side of the hollow sleeve 50C facing the elastic unit 60. The outer wall of the hollow sleeve 50C is attached to the inner wall of the tubular body 10 by a welding means. The diameter of the through hole 54 is less than the diameter of the blind hole 53, so the second side 52 has a cross-sectional area greater than that of the first side 51, thereby achieving the same effect as the first embodiment. The retaining unit 50 can be disposed at the end opening of the first end portion 11, so that the retaining unit 50 can be assembled and positioned with ease and enables to bear a large torsion spring.

Figure 8:
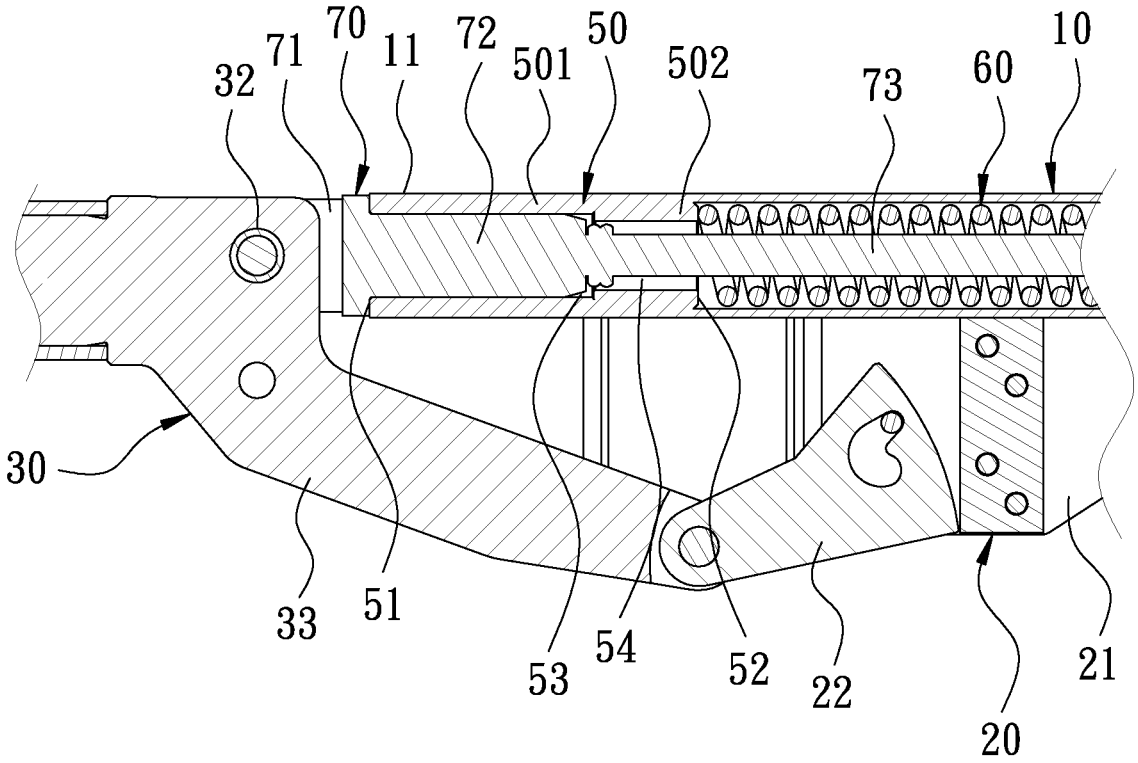
FIG. 8 is a partially enlarged view in accordance with a third embodiment of the present invention.

FIG. 8 is a partially enlarged view in accordance with a third embodiment of the present invention. The torque wrench 100 of the third embodiment is substantially similar to the first embodiment with the exceptions described hereinafter. The retaining unit 50 has a joint portion 501 and a bearing portion 502 integrally connected to the joint portion 501. The joint portion 501 and the bearing portion 502 are integrally formed with the tubular body 10. A radial direction of the joint portion 501 is a closed configuration to form the blind hole 53. A radial direction of the bearing portion 502 is a closed configuration to form the through hole 54. One end of the joint portion 501, adjacent to the driving head 30, is defined as the first end portion 11. One end of the bearing portion 502, adjacent to the elastic unit 60, is defined as the second end portion 12. The first side 51 is formed on the first end portion 11. The second side 52 is formed on the second end portion 12. The extension portion 72 of the push rod 70 is surrounded by the joint portion 501 and is received in the blind hole 53. One end of the elastic unit 60 abuts against the second side 52. Therefore, in addition to the welding means for fixing the retaining unit 50, the retaining unit 50 of the present invention can be integrally formed with the tubular body 10, thereby achieving the same effect as the first embodiment. The retaining unit 50 can be disposed at the end opening of the first end portion 11, so that the retaining unit 50 can be assembled and positioned with ease.

Figure 9:
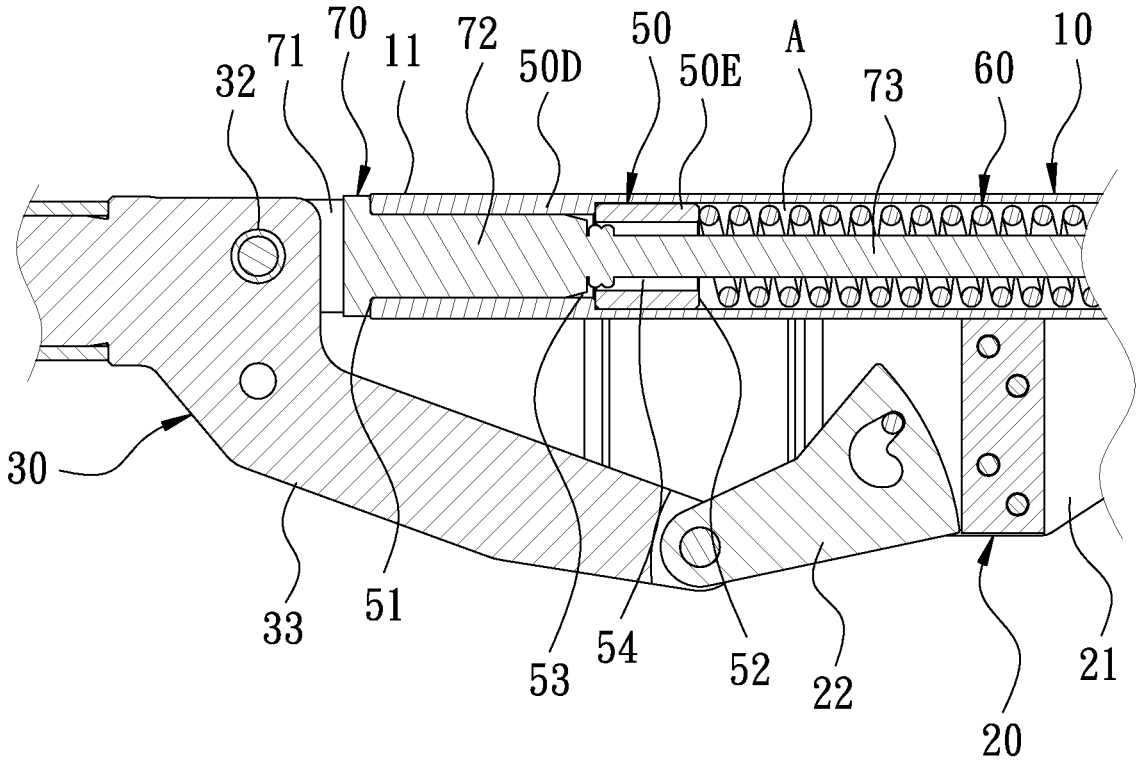
FIG. 9 is a partially enlarged view in accordance with a fourth embodiment of the present invention.

FIG. 9 is a partially enlarged view in accordance with a fourth embodiment of the present invention. The torque wrench 100 of the fourth embodiment is substantially similar to the first embodiment with the exceptions described hereinafter. The retaining unit 50 has a joint portion 50D and a bearing ring 50E. The bearing ring 50E and the elastic unit 60 are disposed in a chamber A of the tubular body 10. The joint portion 50D is integrally formed with the tubular body 10. The radial direction of the joint portion 50D is a closed configuration to form the blind hole 53. The radial direction of the bearing ring 50E is a closed configuration to form the through hole 54. The chamber A communicates with the blind hole 53 and the through hole 54. One end of the bearing ring 50E abuts against one side of the joint portion 50D adjacent to the elastic unit 60. Another end of the bearing ring 50E forms the second side 52 and abuts against the elastic unit 60.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A torque wrench, comprising a tubular body, the tubular body having two ends defined as a first end portion and a second end portion, the first end portion being connected to a driving head through a release mechanism, the second end portion being provided with a grip, a retaining unit being fixed in the tubular body, an elastic unit being received in the tubular body, the elastic unit being inserted into the tubular body from the second end portion, one end of the elastic unit being abutted against the retaining unit, a push rod being insertedly disposed in the tubular body, one end of the push rod being connected to the driving head, another end of the push rod passing through the retaining unit and the elastic unit and being formed with a threaded portion, an adjusting unit being threadedly connected to the threaded portion and abutting against another end of the elastic unit; characterized in that:

the retaining unit is fixedly connected to an end opening of the first end portion, the retaining unit has a first side adjacent to and facing the driving head and a second side adjacent to and facing the elastic unit, the first side is recessed with a hole, the second side is formed with a through hole communicating with the hole, the through hole has a diameter less than that of the hole, the second side has a cross-sectional area greater than that of the first side;

the push rod has a connecting portion connected to the driving head, the connecting portion is provided with an extension portion extending toward the hole, the extension portion has a diameter equivalent to the diameter of the hole so that the extension portion enables to stably slide along an axial direction of the hole, the extension portion is provided with a thin rod portion extending toward the through hole, and the thin rod portion passes through the through hole and the elastic unit and is threadedly connected to the adjusting unit through the threaded portion.

2. The torque wrench as claimed in claim 1, wherein the retaining unit includes a first cylinder fixed at the end opening of the first end portion and a second cylinder located between the first cylinder and the elastic unit, one side of the first cylinder, facing the driving head, is provided with the first side and the hole, and one side of the second cylinder, facing the elastic unit, is provided with the second side and the through hole.

3. The torque wrench as claimed in claim 2, wherein an outer diameter of the first cylinder is approximately the same with an outer diameter of the second cylinder, and an outer wall of the first cylinder is fixedly attached to an inner wall of the tubular body by a welding means to bear the second cylinder and the elastic unit.

4. The torque wrench as claimed in claim 1, wherein the retaining unit is a hollow sleeve, one side of the hollow sleeve, facing the driving head, is provided with the first side and the hole, and another side of the hollow sleeve, facing the elastic unit, is provided with the second side and the through hole.

5. The torque wrench as claimed in claim 4, wherein an outer wall of the hollow sleeve is fixedly attached to an inner wall of the tubular body by a welding means to bear the elastic unit.

6. The torque wrench as claimed in claim 1, wherein the retaining unit is attached to an inner wall of the tubular body by a welding means, and the tubular body has a flared opening at a junction of the inner wall of the tubular body and the end opening of the first end portion.

7. The torque wrench as claimed in claim 1, wherein an outer wall of the retaining unit is formed with a rough surface.

8. The torque wrench as claimed in claim 1, wherein the retaining unit has a joint portion and a bearing portion integrally connected to the joint portion, the joint portion and the bearing portion are integrally formed with the tubular body, a radial direction of the joint portion is a closed configuration to form the hole, a radial direction of the bearing portion is a closed configuration to form the through hole, one side of the joint portion, adjacent to the driving head, is defined as the first side, one side of the bearing portion, adjacent to the elastic unit, is defined as the second side, the extension portion of the push rod is surrounded by the joint portion and is received in the hole, and one end of the elastic unit abuts against the second side.

9. The torque wrench as claimed in claim 1, wherein the tubular body has a chamber therein, the retaining unit has a joint portion and a bearing ring, the bearing ring and the elastic unit are disposed in the chamber, the joint portion is integrally formed with the tubular body, a radial direction of the joint portion is a closed configuration to form the hole, a radial direction of the bearing ring is a closed configuration to form the through hole, the chamber communicates with the hole and the through hole, one end of the bearing ring abuts against one side of the joint portion adjacent to the elastic unit, and another end of the bearing ring abuts against the elastic unit.

* * * * *